US006544299B2

(12) United States Patent
Bell

(10) Patent No.: US 6,544,299 B2
(45) Date of Patent: Apr. 8, 2003

(54) WATER BLEED INHIBITOR SYSTEM

(75) Inventor: Michael E. Bell, Lexington, VA (US)

(73) Assignee: Burlington Industries, Inc., Greensboro, NC (US)

( * ) Notice: Subject to any disclaimer, the term of this patent is extended or adjusted under 35 U.S.C. 154(b) by 108 days.

(21) Appl. No.: 09/778,959

(22) Filed: Feb. 8, 2001

(65) Prior Publication Data

US 2001/0020312 A1 Sep. 13, 2001

Related U.S. Application Data

(63) Continuation-in-part of application No. 09/468,107, filed on Dec. 21, 1999, now abandoned, which is a continuation of application No. 09/217,073, filed on Dec. 21, 1998, now abandoned.

(51) Int. Cl.[7] ..... D06P 1/58; D06P 3/06; D06P 5/08

(52) U.S. Cl. ..... 8/495; 8/557; 8/558; 8/560; 8/539; 8/924

(58) Field of Search ..... 8/539, 924, 557, 8/560, 558, 495

(56) References Cited

U.S. PATENT DOCUMENTS

| | | | |
|---|---|---|---|
| 3,861,869 | A | 1/1975 | Schwindt et al. |
| 4,077,764 | A | 3/1978 | von der Eltz et al. |
| 4,304,567 | A | 12/1981 | Ballmann et al. |
| 4,475,918 | A | 10/1984 | Kissling et al. |
| 4,599,087 | A | 7/1986 | Heller et al. |
| 4,937,123 | A | 6/1990 | Chang et al. |
| 5,013,328 | A | 5/1991 | Annen et al. |
| 5,131,914 | A | 7/1992 | Kelley |
| 5,328,766 | A | 7/1994 | Smith |
| 5,342,417 | A | 8/1994 | Pacifici et al. |
| 5,356,687 | A | 10/1994 | Pechhold |
| 5,401,554 | A | 3/1995 | Armen |
| 5,417,724 | A | 5/1995 | Pacifici et al. |
| 5,436,049 | A | 7/1995 | Hu |
| 5,464,452 | A | 11/1995 | Cole et al. |
| 5,525,125 | A | 6/1996 | Cole et al. |

FOREIGN PATENT DOCUMENTS

| | | |
|---|---|---|
| JP | 057859 | 7/1969 |
| JP | 017906 | 2/1982 |
| JP | 035004 | 2/1985 |
| JP | 215760 | 8/1987 |

*Primary Examiner*—Margaret Einsmann
(74) *Attorney, Agent, or Firm*—Nixon & Vanderhye P.C.

(57) ABSTRACT

Colorfastness of cationic dyeable nylon fibers dyed with acid and/or premetalized acid dyes is enhanced and potential water bleed problems can also be overcome by treating the dyed fibers with an acrylic water bleed fixative in conjunction with a traditional cotton water bleed fixative. In a typical procedure, the acrylic fixative is applied first, followed by the nylon fixative or the cotton fixative.

4 Claims, No Drawings

WATER BLEED INHIBITOR SYSTEM

CROSS REFERENCE TO RELATED APPLICATIONS

This application is a continuation-in-part of application Ser. No. 09/468,107 filed Dec. 21, 1999 now abandoned which is a continuation of Ser. No. 09/217,073 filed Dec. 21, 1998, abandoned. Each of these documents is hereby incorporated by reference in their entirety.

BACKGROUND OF THE INVENTION

When dyeing cationic dyeable yarns to medium and dark shades with acid and/or premetalized acid dyes on a continuous dye range, the dyed product in some instances may exhibit some dye bleed when products containing the dyed yarn are subjected to subsequent wet conditions. U.S. Pat. No. 5,342,417 and 5,417,724 to Pacifici describe methods for reducing cold water bleed using a composition that inhibits water bleeding by treating the dyed yarn with a combination of a cationic sulfonated cotton fixing agent and an anionic polyamine nylon fixing agent.

Dyed textiles sometimes are apt to transfer dye from fiber to fiber, yarn to yarn, and fabric to fabric when they are in contact with each other under aqueous conditions. Colorfastness is measured by the dyed textile's resistance to color loss in an aqueous environment and is referred to as cold water bleed. Various fixing agents have been proposed and are generally targeted or prepared for a specific fiber type. Nylon fixing agents are used to treat nylon textiles dyed with acid dyes while cotton fixing agents are used to treat cellulosic fibers dyed with reactive, direct or vat dyes.

Schwindt et al, U.S. Pat. No. 3,861,869, describes a printing paste for polyamide carpets or the like containing an acrylic acid polymer or copolymer which may also contain an amine compound.

von der Eltz et al, U.S. Pat. No. 4,077,764, describes a process for dyeing polyamide fibers with a binder system combining acrylic acid derivatives with an amine compound such as melamine formaldehyde.

Annen et al, U.S. Pat. No. 5,013,328, aftertreats various textile materials including blends of polyamide and cotton with a cationic material that may be an amide or an amine in the presence of a novolak or similar product and a compound containing a carboxylic acid. This patent does not specifically identify the use of acrylic acid or an acrylic acid derivative.

Kelley, U.S. Pat. No. 5,131,914, describes a multicolored dyeing process for polyamide carpets where acrylic acid polymers and copolymers mixed with sulfonated phenol-aldehyde condensation products are used to prepare an anionic resist which is applied as a print paste, followed by heat fixing.

Japanese Patent Abstract JA-7337069 of 1969 describes a dyeing process for polyamide and other fibers containing an alkyl amine, an aromatic amine and formaldehyde with an emulsion polymer of an acrylic acid ester.

Japanese Patent Abstract JP 1061-584 (1987) treats a dyed polyamide fiber with a copper chloride of methacrylic acid and a polyamine softening agent.

DESCRIPTION OF THE INVENTION

The inventor has discovered that water bleed problems can also be overcome by using an acrylic water bleed fixative in conjunction with either a traditional nylon water bleed fixative or a traditional cotton water bleed fixative. In a typical procedure, the acrylic fixative is applied first, followed by the nylon fixative or the cotton fixative.

The term acrylic water bleed fixing agent means an aqueous composition of (a) polymethacrylic acid, (b) copolymers of methacrylic with an ethylenically unsaturated comonomer, (c) copolymers of methacrylic acid and a novalac type polymer, or combinations of any two or three of these as disclosed in U.S. Pat. No. 5,464,452. The expression cotton fixing agent means a cationic polyamine polymer or polyamide polymer as disclosed in U.S. Pat. No. 5,342,417.

Disclosed is a method of enhancing colorfastness of cationic dyeable nylon fibers dyed with acid and/or premetalized acid dyes by treating the nylon fibers with an acrylic water bleed fixing agent and thereafter with a cotton bleed fixing agent. Alternatively colorfastness of acid dyeable nylon fibers dyed with an anionic dye may be enhanced by treating dyed nylon fibers with an acrylic fixing agent. In any of these procedures the fibers may be steamed subsequent to application of the acrylic fixing agent.

Disclosed is a method of enhancing colorfastness to water of cationic dyeable nylon fibers dyed with acid and/or premetalized acid dyes. The process includes contacting the dyed nylon fibers with an anionic water bleed fixing agent composed of an aqueous solution of (a) polymethacrylic acid, (b) copolymers of methacrylic acid and an ethylenically unsaturated comonomer, (c) copolymers of methacrylic acid and a novalac polymer, or (d) combinations of (a) with (b) or (c) under suitable conditions to fix the bleed fixing agent for use on nylon fibers to the nylon. Thereafter a cationic polyamine or polyamide fixing agent is applied. The cationic polyamine or polyamide polymer fixing agent reacts with the anionic water bleed fixing agent to form a network that prevents and/or reduces transfer of dye from the nylon fibers to other textile materials.

Also disclosed is method for enhancing colorfastness to water of acid dyeable nylon dyed with an anionic dye comprising treating the acid dycable nylon fibers with an anionic fixing agent comprising an aqueous solution of (a) polymethacrylic acid, (b) copolymers of methacrylic acid and an ethylenically unsaturated comonomer, (c) copolymers of methacrylic acid and a novalac polymer, or combinations (a) with (b) or (c) at pH 2.5–3.5 for a time and under conditions sufficient to enhance colorfastness.

The water bleed fixing agent may be applied in a continuous process such as padding, steaming, and rinsing with water followed by drying.

For medium to dark shades dyed with acid and/or premetallized dyes on a continuous dye range, cationic dyeable and acid dyeable nylon may exhibit a dye bleed problem when the substrate, or carpet and module products incorporating the substrate, are subjected to subsequent wet conditions. Commercially available chemicals to reduce this for acid dyeable nylon are effective for most dye combinations. There have also been systems available for cationic dyeable nylon that requires a two-step process.

The present invention is effective in reducing or inhibiting cold water bleed on the cationic dyeable nylon using an acrylic based product in conjunction with a traditional cotton water bleed fixative.

The process of the present invention, particularly regarding acid dyeable nylon fiber is to be distinguished from procedures to prevent further dyeing (staining) of acid dyeable nylon fibers with acid dyes from external sources, i.e. food dyes. Acid dyeable nylon fibers are often used in stain resistant carpets. The objective of water bleed fixing of the present invention is to prevent dye applied as part of the manufacture of the initial color from migrating and fixing to an area where that, color is not wanted, either within the same carpet or onto another textile surface.

In a procedure illustrative of the invention, after normal steaming and washing during the dye process, for example as disclosed in U.S. Pat. No. 5,085,667, the yarn is immersed in a bath containing a solution of acrylic fixative material (Polyacid B from Peach State Labs) at a pH of 2–2.5. The yarn is squeezed to a final wet pick up to apply a nominal 2% of the acrylic composition to the yarn.

The treated yarn is then steamed for 1–2 minutes.

Next the yarn is immersed in a bath of a cotton fixative (Neofix R-250, from NICCA, U.S.A.), a cationic polyamide type polymer used as a cotton fixing agent. Wet pick up for this step is about twice the rate of the acrylic material.

After application of cotton fixative the yarn is left undisturbed for 20–30 seconds before washing and further processing as is normal for continuously dyed goods.

For acid dyeable nylon yarn, the process is the same through the first two steps while application of the second treatment is omitted. Alternatively, the process may be reversed, that is the acrylic fixative is applied after the cotton fix.

The acrylic fixative may also be exhausted onto the yarn in an exhaust dye system. As an illustration after dyeing and rinsing, sufficient acrylic fixative to achieve 2% to 4% add-on would be added to the bath. The pH is adjusted to 2–2.5 and the temperature raised.

A. Exhaust:

Three dark shades were dyed using cationic dyeable nylon yarn with premetalized acid dye and milling acid dyes. Shades (red, blue, green) were selected to cover the range of dyes. Six samples were prepared. The acrylic/phenolic blend in C was obtained from Peach State, while the acrylic agent used in D, E, and F was obtained according to Cole U.S. Pat. Nos. 5,464,452 and 5,525,125, the disclosures of which are incorporated by reference. The effectiveness of the dye-fixative compositions was tested for colorfastness to water using AATCC Test Method 107–1991. Test Solution: Freshly boiled distilled water or deionized water from an ion-exchange apparatus.

Test Specimens: Cationic dyeable nylon yarn dyed with a premetalized acid dye.

Procedure:

(1) The test specimen is immersed in the test solution at room temperature with occasional agitation to insure thorough wetting out for a period of 15 minutes.

(2) The test specimen is then removed from the test solution and is then passed through a wringer to remove excess liquor when the weight of the test specimen is more than 3 times its dry weight. Whenever possible, the wet weight should be 2.5–3.0 times the dry weight of the test specimen.

(3) The test specimen is then placed between glass or plastic plates and inserted into the specimen unit of an AATCC perspiration tester. The perspiration tester is adjusted to produce a pressure of 4.536 kg on the test specimen.

(4) The test specimen is then heated in an oven at 38°±1° C. for approximately 18 hours.

(5) The test specimen is then removed from the unit and hung in air at room temperature to complete the drying procedure.

Evaluation Method For Color Change: The test specimen was then rated on a scale from 5 to 1 for color, based on the Gray Scale for Color Change. The scale is from 5 to 1, with 5 representing negligible or no change in color, and 1 representing a significant change in color. The six test samples A–F were:

A. No aftertreatment

B. 2% Simcofix N201A

C. 2% Acrylic/Phenolic

D. 2% Acrylic

E. 3% Acrylic

F. 4% Acrylic

All treatments were for 20 minutes at pH 2–2.3 and 160–180° F. in a fresh bath after dyeing. Color transfer as rated by AATCC TM-107, 1997 was as follows:

| | Colors | | |
|---|---|---|---|
| Treatment | Red | Blue | Green |
| A | 1 | 2 | 0–1 |
| B | 4–5 | 5 | 4 |
| C | 5 | 5 | 4–5 |
| D | 4 | 4 | 3–4 |
| E | 4 | 4 | 3–4 |
| F | 4–5 | 4–5 | 4 |

Cole et al reported a pH of between 4.0 and 5.0, preferably 4.5 for the acrylic. We tested 3% of this material applied as an after treatment for exhaust dyeing at pH 2.5, 3.5 and 4.5 on both acid dyeable and cationic dyeable nylon. Results for color transfer per AATCC TM-107 were as follows:

| I. Acid Dyeable | | | |
|---|---|---|---|
| | Colors | | |
| pH | Red | Blue | Green |
| 2.5 | 5 | 5 | 5 |
| 3.5 | 5 | 5 | 4–5 |
| 4.5 | 5 | 5 | 3–4 |

| II. Cationic Dyeable | | | |
|---|---|---|---|
| | Colors | | |
| pH | Red | Blue | Green |
| 2.5 | 4–5 | 4 | 2–3 |
| 3.5 | 4 | 3–4 | 2 |
| 4.5 | 3 | 3 | 1–2 |

*Sample misplaced, probably 1 or less.

These results expand the pH range of the Cole patents and reveal the dye type relationship on cationic dyeable yarn. Combined with the results in the first test above, at least 4% acrylic is desirable for most applications.

B. Continuous Dyeing:

The same three shades were used as in exhaust dyeing. While tests were conducted only with cationic dyeable nylon yarn, equal or better results are expected for acid dyeable nylon yarn. After padding, steaming and rinsing, the knit-deknit dyed sock of yam was after treated with each of the following combinations (in the case of samples E, F and G, a coupler was added for clarity):

A. Control, dyed but not after treated.

B. 2.0% Simcofix N201A, a nylon dye fixing agent which is a novalac type polymer; (see U.S. Pat. Nos. 5,342,417 and 5,417,724, noted above), pH 2.0–2.5 followed by steaming and application of 4.0% coupler (a cationic polyamine or polyamide fixing agent), pH as is. Sock was held 20 seconds, then rinsed and dried.

C. B above, but pH of the coupler adjusted to 2.0–2.5.

D. 2.0% acrylic/phenolic and coupler applied as in B.

E. 4.0% acrylic and 4% coupler applied as in B.

F. 4.0% acrylic and 4% coupler applied as in C above.

G. 4.0% acrylic and 4% NICCA coupler applied as in C above.

Results for color transfer per AATCC TM-107 were as follows:

| | Colors | | |
|---|---|---|---|
| Treatment | Red | Blue | Green |
| A | 0–1 | N/A* | 1 |
| B | 3–4 | 4 | 3 |
| C | 4 | 4 | 3–4 |
| D | 4 | 4 | 3–4 |
| E | 3 | 3 | 2–3 |
| F | 3 | 2 | 2 |
| G | 2–3 | 2 | 3–4 |

Based upon these results, it was concluded the acrylic and couplers did not perform as well as the other combinations although all improved water bleed. The acrylic/phenolic was equal to the phenolic. Quite surprisingly, acrylic couplers by themselves may be particularly attractive for fixative use on cationic dyeable nylon fibers and other benefits even when used by themselves.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of enhancing colorfastness to water of cationic dyeable nylon fibers dyed with acid and/or premetalized acid dyes, the process comprising contacting the dyed nylon fibers with an anionic water bleed fixing agent comprising an aqueous solution of (a) polymethacrylic acid, (b) copolymers of methacrylic acid and an ethylenically unsaturated comonomer, (c) copolymers of methacrylic acid and a novalac polymer, or (d) combinations of (a)with (b) or (c) under conditions to fix said bleed fixing agent for use on nylon fibers to the nylon, and thereafter applying a cationic polyamine or polyamide fixing agent, wherein the cationic polymer fixing agent reacts with the anionic water bleed fixing agent to form a network that prevents and/or reduces transfer of dye from the nylon fibers to other textile materials.

2. A process of claim 1 in which the nylon fibers are steamed subsequent to application of the acrylic water bleed fixing agent.

3. A method for enhancing colorfastness to water and reducing transfer of dye from fiber to fiber, yarn to yarn, fabric to fabric when they are in contact with each other under aqueous conditions of acid dyeable nylon dyed with an anionic dye comprising treating the acid dyeable nylon fibers with an anionic fixing agent comprising an aqueous solution of (a) polymethacrylic acid, (b) copolymers of methacrylic acid and an ethylenically unsaturated comonomer, (c) copolymers of methacrylic acid and a novalac polymer, or combinations of both (a) and (b) at pH 2.5–3.5 for a time and under conditions sufficient to enhance colorfastness.

4. A process of claim 3 in which the water bleed fixing agent is applied in a continuous process comprising padding, steaming, rinsing with water and thereafter drying.

* * * * *